United States Patent [19]

Capitao, Jr.

[11] Patent Number: 4,570,794

[45] Date of Patent: Feb. 18, 1986

[54] SUSPENSION PACKAGING FOR FILM ROLLS

[75] Inventor: Manuel Capitao, Jr., Bradford, Mass.

[73] Assignee: Borden, Inc., Columbus, Ohio

[21] Appl. No.: 636,252

[22] Filed: Jul. 31, 1984

[51] Int. Cl.[4] ..... B65D 85/672

[52] U.S. Cl. ..... 206/394; 206/407; 206/408

[58] Field of Search ..... 206/389, 391, 394, 407, 206/408; 229/175, 5.5, 4.5

[56] References Cited

U.S. PATENT DOCUMENTS

| | | | |
|---|---|---|---|
| 1,735,853 | 11/1929 | Dreux | 229/5.5 |
| 1,760,754 | 5/1930 | Hayden . | |
| 1,858,105 | 5/1932 | Mulrey . | |
| 2,030,465 | 2/1936 | Nist . | |
| 2,424,553 | 7/1947 | Conti | 206/408 |
| 2,607,476 | 8/1952 | Rockefeller | 206/408 |
| 2,715,458 | 8/1955 | Polglase . | |
| 2,718,303 | 9/1955 | Polglase . | |
| 2,853,185 | 9/1958 | Rollie | 206/407 |
| 3,227,272 | 1/1966 | Critzer | 206/408 X |
| 3,229,812 | 1/1966 | Metzger | 229/175 |
| 3,280,987 | 10/1966 | Steinbock . | |
| 3,281,033 | 10/1966 | Stutzman et al. | 206/408 X |
| 3,371,776 | 3/1968 | Voissem | 206/394 |
| 3,530,980 | 9/1970 | Link . | |
| 3,613,973 | 10/1971 | Jaeschke | 229/175 |
| 3,670,946 | 6/1972 | Croley | 229/4.5 |
| 3,685,644 | 8/1972 | Cothran et al. | 206/408 |
| 3,698,548 | 10/1972 | Stenzel et al. | 229/175 |
| 3,768,641 | 10/1973 | Jerzewski, Jr. . | |
| 3,981,400 | 9/1976 | Quintana | 206/407 |
| 4,033,455 | 7/1977 | Robison . | |
| 4,079,835 | 3/1978 | Kendig . | |
| 4,120,398 | 10/1978 | Braddon, Sr. . | |
| 4,122,949 | 10/1978 | Blatt . | |
| 4,195,732 | 4/1980 | Bell . | |
| 4,231,475 | 11/1980 | Kessler . | |
| 4,273,392 | 6/1981 | Stinson . | |

FOREIGN PATENT DOCUMENTS

| | | | |
|---|---|---|---|
| 2401850 | 4/1979 | France | 206/394 |

*Primary Examiner*—Allan N. Shoap
*Assistant Examiner*—Bryon Gehman
*Attorney, Agent, or Firm*—Robbins & Laramie

[57] ABSTRACT

Package of a plurality of unitized film rolls of polymeric wrapping film. Each roll is suspended on its core within the bulk package so as to be separate from each other film roll in the package, and so as to be physically spaced from confronting surfaces of the package. The film on each film roll is thus available to the customer free from distortion, abrasion and edge damage.

3 Claims, 2 Drawing Figures

SUSPENSION PACKAGING FOR FILM ROLLS

BACKGROUND OF THE INVENTION

1. Field of the Invention

This invention relates to packaging for film that is manufactured and shipped in roll form. More particularly, the invention relates to a new form of packaging that is designed to offer protection against distortion, abrasion and edge damage for a plurality of rolls per package of synthetic plastic film.

2. Description of the Prior Art

Transparent film made from synthetic plastic is in widespread use for packaging cuts of meat, cheese, and other foodstuffs and materials. Plasticized polyvinyl chloride and polypropylene are synthetic plastic materials often used in making plastic wrapping film.

This kind of film is usually manufactured, sold, and shipped in the form of rolls. To make a film roll, a web of the plastic film, of predetermined width, is wrapped around a rigid tubular core. The core is often made from heavy cardboard or other suitable, inexpensive material. Because the film is easily damaged, and thermoplastic, it requires careful handling during manufacture, careful packaging and handling during shipment, and care during dispensing from the roll and use. Damage may take the form of distortion, abrasion that mars the transparency of the film, or damage to the film edge that might lead to a variety of undesirable consequences. Edge damage to the film in a roll, for example, tends to interfere with the orderly dispensing of the film from the roll. If the edge damage is severe enough, it may even prevent the film from being unwound without damage, thus rendering some part of the roll useless to the user, with resulting waste.

There have been several attempts to ameliorate these problems in recent years. In one approach, triangular corrugated mandrels are inserted through the bores of the cores of several film rolls, to unitize the rolls on each mandrel. The loaded mandrels are then disposed vertically, so that one roll is, in effect, stacked on top of another. Stability is poor with this arrangement, sometimes leading to damage when the instability causes undesired or unanticipated movement of a stack of the rolls.

In a second approach, foamed plastic has been fabricated into rigid foamed trays that are shaped so that a pair of trays can cradle the ends of several film rolls. The end portions of a given film roll are seated in recesses in a pair of such trays, and each set of trays can accommodate the ends of several film rolls, side by side. The trays are stacked one on the other to make an array several trays high. Metal strapping is then used to secure the set of trays together, to unitize as many as a dozen film rolls. In the usual such design, the film rests directly on the trays, but unfortunately, damage and distortion still results.

In still another approach, master cartons using double end caps are used to unitize rolls, but no means are provided for suspension. The roll of film thus rests directly on the side of the carton, with the consequent opportunity for abrasion and other damage.

SUMMARY OF THE INVENTION

The present invention is a package for a plurality of rolls of polymeric wrapping film. The package is designed to accommodate a plurality of film rolls in unitized fashion, with each roll disposed so that it is supported on its core out of contact with each other roll in the package and out of contact with the internal surfaces of the box in which the rolls are packed.

Each film roll is formed to have a core and a plurality of convolutions of the film wound on its core. Each core is generally cylindrical and is of greater width than the width of the wound film, so that the ends of the core project from each side of the wound film. Each core also has a bore.

The package for the film rolls comprises a box having sides and ends. The box is long enough to accommodate two or more film rolls in a side-by-side arrangement, with their cores aligned and the bores of their cores in registry. A mandrel, that is removably inserted through the cores of all of the film rolls, extends almost from end to end of the box. This mandrel is preferably generally cylindrical and its diameter is such that the mandrel can be inserted through the bores of the cores of the film rolls, with a sliding fit.

The two or more film rolls that are packaged in the box are mounted on the mandrel. The mandrel in turn is supported intermediate its ends by at least one partition panel that is inserted in the box. Preferably, a partition panel is disposed in the box intermediate each adjacent pair of film rolls. Each partition panel is formed with a central opening, and the mandrel projects through the opening, with a sufficiently snug fit so that the partition panel offers circumferential support for the mandrel. In addition, the partition panel functions as a separator for the confronting ends of the cores of two adjacent film rolls. There is also a partition panel at each end of the unitized rolls on the mandrel.

End caps are provided for insertion into the ends of the film roll cores at the opposite ends of the unitized rolls, that confront the end walls of the box respectively. These end caps are designed with bosses that can be inserted through central openings in the partition panels at the ends of the unitized rolls, and into the bores of the end cores, respectively. The end caps thus support those film rolls in the ends of whose cores they are inserted, getting circumferential support themselves from the end partition panels. They also confine the mandrel within the bores of the cores of the film rolls, to function as retainers.

The box may be of conventional construction. It should be of a size such that several film rolls can be accommodated, supported by the mandrel, end caps, and by the inserted partition panels, on which the mandrel and the end caps rest. The film rolls are kept out of contact, so far as the film is concerned, with other parts of the box, and with each other. This prevents possible damage to the film.

DETAILED DESCRIPTION OF THE INVENTION

Figure 1:
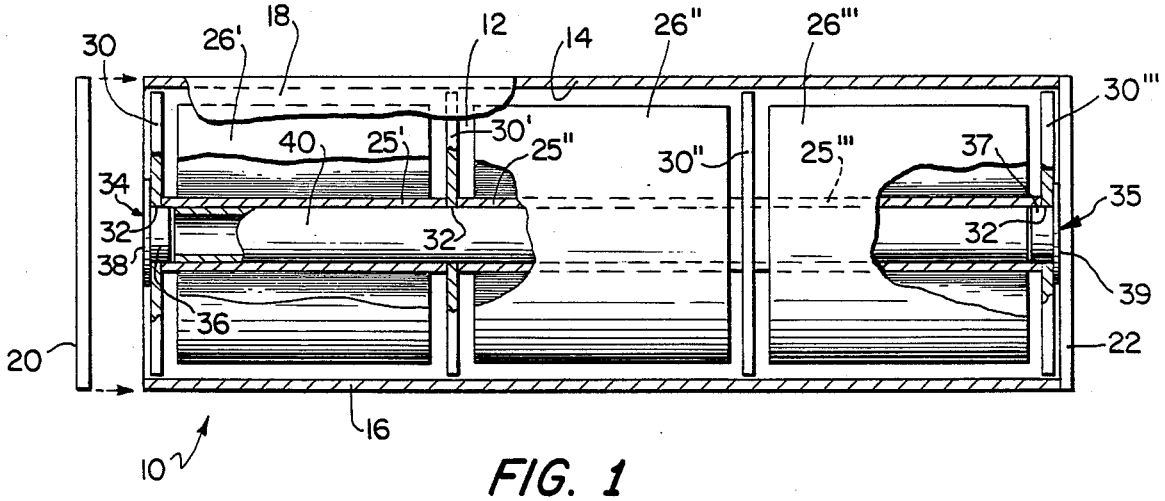
FIG. 1 is a top plan view, partly broken away, partly in section, and partly exploded, of a suspension package for three film rolls, the top of the box being broken away to expose its contents, the package being constructed in accordance with one preferred embodiment of the invention.

Referring now in detail to the drawings by numerals of reference, the numeral 10 denotes generally the package shown in FIG. 1, showing the unitized three rolls of film in a five panel folder type box, ready for shipment, storage, or use. The box is of conventional construction, designed to accommodate film rolls whose aligned and abutted cores have a total length, for purposes of describing this embodiment of the invention, of about 30 inches. The box thus may be used, for example, to accommodate two rolls having cores almost 15 inches wide, or three film rolls each having 10 inch cores, or six film rolls each having 5 inch cores.

The packing box is the form of a parallelipiped. It has a bottom panel 12, a pair of side walls 14, 16, and a top 18 that is connected to the upper end of the side wall 14. The box is also formed with a pair of end panels 20, 22.

The invention is illustrated in FIG. 1 as applicable to the packaging of three film rolls that, for purposes of exposition, have cores that are each approximately 10 inches wide. The three film rolls are identical in construction. Each consists of a rigid cardboard or equivalent core 25, the core being cylindrical in form and having a bore. The film 26 is wound on the core 25, in a plurality of convolutions. As wound, the size of the film roll is such that if inserted in the box, and supported to be spaced from each confronting surface of the box, there would be clearance, preferably of about ½ inch or so, between the outermost convolution of film and the confronting surfaces of the sides 14, 16, and of the top 18 and bottom 12 of the box.

In a typical film roll produced for commercial purposes, from plasticized polyvinyl chloride film, about 3000 convolutions of film are wound on a single core. The winding is accomplished under tension, with a representative value of tension being about ½ lb./in. of width of the film during winding. The film thickness may be any gauge desired, with a thickness of 0.00075 inches being representative.

To form a unitized assembly of the three film rolls for insertion in the box, four partition panels 30 are provided. Two of these are to be positioned between the cores of the three film rolls respectively, and the other two at the opposite ends of the three aligned rolls, as a part of the unitization process. Each of these partition panels 30 is formed with a central opening 32 that registers with the bores of the cores upon assembly as shown in FIG. 1. The partition panels 30 are alike in construction, and the central circular opening 32 of each has a diameter that is generally the same as the diameter of the bore of the cores of the film rolls, which are uniform.

Two end caps 34, 35 are provided for each unitized assembly. Each end cap is formed with a central boss 36, 37, respectively, and a peripheral flange 38, 39, respectively. The boss of each end cap is proportioned so that it can be inserted through the central openings 32 in the partition panels 30, and into the bores of the cores 25 of the adjacent film rolls. The end caps thus can secure partition panels in place against the end faces of the cores of the film rolls.

The next step in unitization is to place one end cap 34 on a support, such as a table or the floor. The panel 30 is placed over the end cap 34, with the boss 36 of the end cap projecting through the central opening 32 of the panel. A film roll 26' is then put in place, with the boss 36 of the end cap 34 inserted in the bore of its core 25'. Thus the end face of the core 25' abuts against the panel 30. A second panel 30' is then rested on the other end face of the core 25', with its central opening 32 aligned with the bore of the core 25'. The mandrel 40 is then inserted into the bore of the core 25' of the film roll 26'. The diameter of the mandrel 40 preferably is such that it slides easily into the bore of the core 25' of the film roll 26', and also passes easily through the central aperture 32 in the partition panel 30'. A second film roll 26'' is then placed on the mandrel 40, by sliding its core 25'' over the mandrel. Another partition panel 30'' is then placed over the mandrel, so that it abuts against the end of the core 25'' of the second film roll 26''. Finally, a third film roll 26''' is mounted on the mandrel, by sliding its core 25''' over the mandrel. A third partition panel 30''' is then placed against the end face of the core 25''' of the film roll 26'''. The second end cap 35 is then put in place, with its boss 37 inserted through the central opening 32 of the end panel 30''', and projecting into the bore of the core 25'''. The end caps 34 and 35 thus serve as fasteners in holding the end parts of the assembly together, and as retainers for keeping the mandrel 40 in place.

The partition panels serve as spacers and cushioning agents between the cores 25' and 25'', and 25'' and 25''', respectively, of the three film rolls 26', 26'' and 26'''. They all also serve as supports, carrying the weights of the three film rolls and of the mandrel, when the assembly is in a horizontal rather than a vertical position.

To complete the packaging operation, the now unitized film rolls, partition panels, and caps, and the mandrel 40, are inserted into the box as a unit. To do this, one of the ends 20 or 22 of the box is moved to open the box, and the unitized load is inserted in the box through its open end. Alternatively, the unitized assembly may remain vertical, and the box may be slid over the upright assembly, then tilted to a horizontal position to permit the box to be closed. The end of the box is then closed any may be taped in place, if desired, to seal the package.

The proportions of the parts should be such that the end faces of the end caps 34, 35, and the partition panels through which they are inserted, are snugly engaged against the inner faces of the ends 20, 22 respectively of the box. The mandrel 40 seats snugly within the central openings 32 in the two intermediate partition panels in the unitized film rolls, and is supported by them. The weight of the three film rolls is thus borne partly by the mandrel and therefore partly by the two intermediate partition panels 30' and 30'', respectively, and partly by the partition panels 30, 30''', that confront and engage against the inner faces of the ends 20, 22 of the box when it is closed. The weight of the two end film rolls in the unitized assembly is transmitted to these end partition panels 30, 30''', because their cores are seated on the end cap bosses 36, 37, respectively, and those bosses in turn are snugly engaged in the central openings 32 in the two outermost partition panels, respectively.

Figure 2:
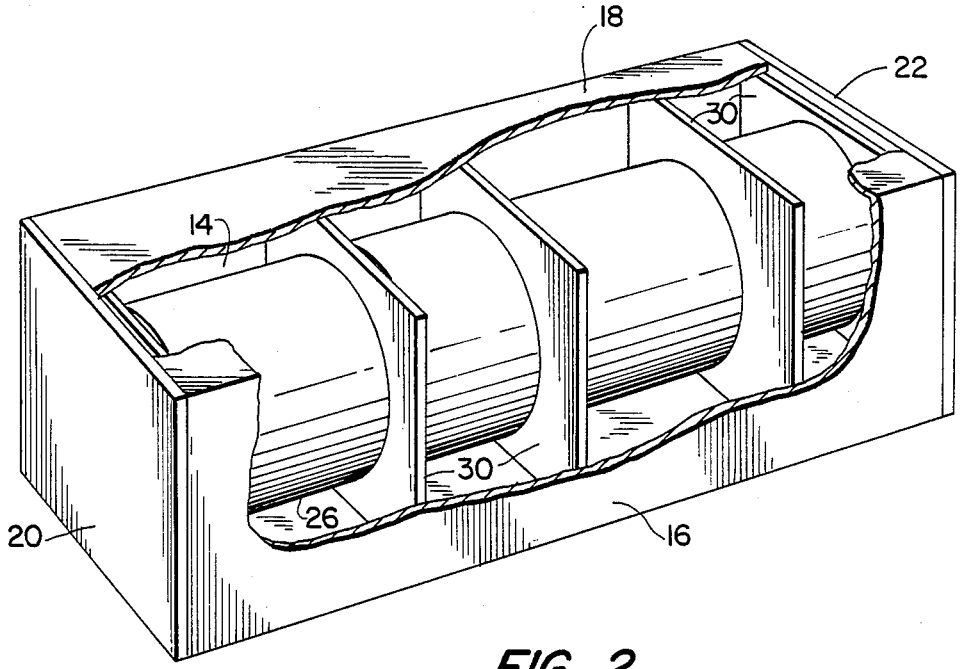
FIG. 2 is a perspective view, partly broken away, of a somewhat different embodiment of the invention, where the four film rolls in the package are not of uniform width, the rolls being shown assembled on the mandrel (which cannot be seen in this view), separated by and supported on the appropriate partition panels in a shipping box.

In FIG. 2, like numerals are used to refer to like components shown in FIG. 1. As shown in the cutaway version in FIG. 2, the invention is applicable to the packaging of film rolls of different widths in a single carton or box. For the sake of economy, it is preferred that conventionally designed boxes be used, so that to accommodate film rolls of non-uniform widths within a single box, the total overall length of the unitized assembly, that is to be inserted into the box, must be consistent with the internal dimensions of the box.

When the system is designed in accordance with this invention, each film roll will be suspended within the box, with the film itself out of contact with adjacent rolls, out of contact with the partition panels, and out of contact with the sides, bottom, and top of the box. The several film rolls in a given package are, in effect, suspended within that package, protected from each other by being spaced from each other, and protected from the box by being spaced from the exterior structural parts of the box itself. Given reasonable care in shipping, storage, and handling, the customer should be assured of receiving the film rolls free from mechanical abuse, and in essentially the same condition in which they were manufactured at the factory.

At the same time that superior packaging is made available through this invention, the customer's need for a bulk pack package is satisfied, to minimize unpacking and handling by the customer, and to increase customer productivity. The packaging of the invention is superior in part because it offers superior protection to the film rolls.

The box used for the practice of the invention may be of a single, standard size. To insure a snug fit of all unitized loads in their boxes, regardless of the number of film rolls per box, it is most convenient to design the parts so that when five rolls are in a single, unitized roll, for example, there is a snug fit with essentially no play. Thus the packed box may be picked up at one end without having one film roll hit another, with resulting damage to the film. To avoid play when there are only two or three rolls of film in a package, extra partition panels may be used, to take up the slack, if necessary.

The mandrel may be made from any strong material of the proper size. A satisfactory mandrel can be made, for example, by folding a suitable length of heavy corrugated paper to have a triangular transverse section, then inserting it into the aligned cores and partition panels. Mandrels may also be made from wood, plastic, heavy cardboard, and the like. It is also possible to use core stock that has been salvaged from used film rolls and crushed and broken apart lengthwise into two halves. Each half makes an adequate mandrel, since the crushing normally reduces the dimensions of the core fragment so that it slides easily into the bore of a pristine core. The strength is adequate. The mandrel may be a single, continuous rod, or it may be formed from two or more pieces that abut against each other. The important feature is that there be a length of mandrel material traversing each intermediate partition panel, to transmit the weight of the film rolls to the partition panel.

While the invention has been disclosed in this patent application by reference to the details of preferred embodiments of the invention, it is to be understood that this disclosure is intended in an illustrative rather than in a limiting sense, as it is contemplated that modifications will readily occur to those skilled in the art, within the spirit of the invention and the scope of the appended claims.

I claim:

1. A package for a plurality of rolls of polymeric wrapping film, said package being designed so that no part of the package is in contact with the polymeric wrapping film, each said film roll comprising a core and a plurality of convolutions of said film wound on its said core, each said core being generally cylindrical and having a bore, and each said core being of greater axial length than the axial length of the wound film so that there is an end of the core projecting from each side of the wound roll of film, said package comprising a box having sides and ends and that is long enough to accommodate at least two of said rolls of film in a side-by-side arrangement with their cores aligned on a generally common axis.

at least two of said film rolls being disposed in said box with their cores aligned on a generally common axis, first partition means disposed in said box intermediate said adjacent pair of film rolls and interposed between the cores of said rolls and disposed in parallelism with said box ends, and other, second partition means disposed in said box adjacent and engaging against the ends of said box respectively, each said partition means being formed with a central opening that is in registry with the bores of said cores of said film rolls, each said partition means engaging against and being supported from the inner surfaces of the sides of said box, mandrel means inserted in the bores of said cores and through the central openings in said first partition means, said mandrel means having a lesser axial length than the axial length of the aligned cores of said rolls and said first partition means, but projecting through the central opening of said first partition means and being supported thereon, a pair of caps each having a central boss and a peripheral flange, the bosses of said caps being inserted respectively through said central openings of said second partition means at the opposite ends of said box respectively, and extending into the ends of the cores of said film rolls adjacent the respective opposite box ends in a snug fit, said mandrel means thereby being confined within the aligned bores of said cores spaced axially from said bosses and said second partition means, and said mandrel means engaging against and resting on said first partition means and thereby, with said end caps, supporting said rolls in the box on said partition means, said rolls being positioned so that the wound film is spaced from and is not in contact with the walls or ends of the box, and is spaced from and not in contact with the wound film on any adjacent roll, the inner, confronting film edges of the wound film on adjacent film rolls being spaced apart from each other and also from the partition that is disposed intermediate the rolls, by reason of the ends of the cores projecting from the film rolls.

2. The package of claim 1, wherein the central opening of said partition means that is intermediate the film rolls is proportioned to fit closely about said mandrel, to provide circumferential support for the mandrel.

3. The package of claim 2, wherein the inner faces of said end caps each lie in a plane, and engage against the confronting faces of the ends of mandrel.

* * * * *